US010290410B2

(12) United States Patent
Halder et al.

(10) Patent No.: US 10,290,410 B2
(45) Date of Patent: May 14, 2019

(54) ELECTROMAGNETIC CAMSHAFT ADJUSTER

(71) Applicant: Kendrion (Villingen) GmbH, Villingen-Schwenningen (DE)

(72) Inventors: Dominik Halder, Dauchingen (DE); Pedro Marull-Kessler, Mönchweiler (DE); Wolfram Maiwald, Villingen-Schwenningen (DE); Tsuneo Suzuki, Mönchweiler (DE); Harald Burkart, Villingen-Schwenningen (DE)

(73) Assignee: Kendrion (Villingen) GmbH, Villingen-Schwenninge (DE)

( * ) Notice: Subject to any disclaimer, the term of this patent is extended or adjusted under 35 U.S.C. 154(b) by 78 days.

(21) Appl. No.: 15/322,422

(22) PCT Filed: Jun. 30, 2015

(86) PCT No.: PCT/EP2015/064896
§ 371 (c)(1),
(2) Date: Dec. 27, 2016

(87) PCT Pub. No.: WO2016/001254
PCT Pub. Date: Jan. 7, 2016

(65) Prior Publication Data

US 2018/0144855 A1 May 24, 2018

(30) Foreign Application Priority Data

Jun. 30, 2014 (DE) ..... 10 2014 109 124

(51) Int. Cl.
*H01F 7/122* (2006.01)
*H01F 7/08* (2006.01)
(Continued)

(52) U.S. Cl.
CPC ..... *H01F 7/081* (2013.01); *H01F 7/06* (2013.01); *H01F 7/088* (2013.01); *H01F 7/121* (2013.01);
(Continued)

(58) Field of Classification Search
CPC ..... H01F 7/122; H01F 7/1615
(Continued)

(56) References Cited

U.S. PATENT DOCUMENTS 5,627,504 A 5/1997 Kleinhappl
6,967,550 B2 11/2005 Elendt et al.
(Continued)

FOREIGN PATENT DOCUMENTS

CN 102369341 3/2012
CN 203179648 9/2013
(Continued)

OTHER PUBLICATIONS

State Intellectual Property Office of China, "Office Action," issued in Chinese Patent Application No. 201580035952.X, document of 6 pages, dated Oct. 9, 2017.
(Continued)

*Primary Examiner* — Ramon M Barrera
(74) *Attorney, Agent, or Firm* — Akerman LLP; Peter A. Chiabotti

(57) ABSTRACT

A electromagnetic camshaft adjuster comprising: an armature unit which can be moved relative to a pole core when a stationary coil unit is energized and which has an armature plunger; and a permanent magnet unit by means of which the armature unit is held in a rest position when the coil unit is not energized; and a spring element between the pole core and the armature unit to force the armature unit axially away from the pole core, the spring force of the spring element being chosen smaller than the holding force of the perma-
(Continued)

nent magnet unit when the coil unit is not energized. The permanent magnet unit is stationarily arranged between a housing cover and the pole core, the armature plunger is rotationally arranged, and the spring element is supported on a part of the armature unit which is rotationally fixedly mounted.

17 Claims, 1 Drawing Sheet

(51) Int. Cl.

| | |
|---|---|
| ***H01F 7/16*** | (2006.01) |
| ***H01F 7/06*** | (2006.01) |
| ***H01F 7/121*** | (2006.01) |
| ***H01F 7/126*** | (2006.01) |

(52) U.S. Cl.
CPC ..... *H01F 7/122* (2013.01); *H01F 7/126* (2013.01); *H01F 7/1615* (2013.01); *H01F 2007/086* (2013.01)

(58) Field of Classification Search
USPC ..... 335/229–234
See application file for complete search history.

(56) References Cited

U.S. PATENT DOCUMENTS

| | | | | |
|---|---|---|---|---|
| 8,402,934 | B2 | 3/2013 | Bender | |
| 2004/0201441 | A1 | 10/2004 | Elendt et al. | |
| 2005/0093664 | A1* | 5/2005 | Lanni ..... | H01F 7/081 335/220 |
| 2012/0031362 | A1 | 2/2012 | Bender | |
| 2013/0147583 | A1 | 6/2013 | Schiepp et al. | |

FOREIGN PATENT DOCUMENTS

| | | |
|---|---|---|
| DE | 102009049009 | 4/2011 |
| DE | 102010045601 | 3/2012 |
| DE | 202011052220 | 3/2013 |
| EP | 1421591 | 10/2007 |
| EP | 2252774 | 10/2011 |
| JP | 2007258150 | 10/2007 |
| WO | 2010112111 | 10/2010 |
| WO | 2011042273 | 4/2011 |

OTHER PUBLICATIONS

Patent Cooperation Treaty, "International Search Report" and translation thereof, issued in International Application No. PCT/EP2015/064896, by European Searching Authority, document of 5 pages, dated Nov. 26, 2015.

* cited by examiner

ELECTROMAGNETIC CAMSHAFT ADJUSTER

CROSS REFERENCE TO RELATED APPLICATIONS

This application is a § 371 National Phase of PCT/EP2015/064896, filed Jun. 30, 2015, the entirety of which is incorporated by reference and which claims priority to German Patent Application No. 10 2014 109 124.8, filed Jun. 30, 2014.

BACKGROUND

The application relates to an electromagnetic camshaft adjuster having an armature unit that can be moved relative to a pole core by energising a stationary coil unit and that has an armature plunger as well as a permanent magnet unit, through which the armature unit is held in a resting position in the non-energised condition of the coil unit.

Such an electromagnetic camshaft adjuster is known for example from DE 20 2011 052 220 U1. The permanent magnet unit there has a disc-shaped permanent magnet that is received between a first and second magnetically conductive pole discs. The two pole discs are here welded together with the armature plunger. The end of the armature plunger that protrudes from the housing of the electromagnetic camshaft adjuster engages in a circumferential groove of a cam that can be adjusted on a camshaft. When the coil of the electromagnetic camshaft adjuster is energised, the plunger is forced in the direction of the camshaft and is set back by the camshaft during rotation. This electromagnetic camshaft adjuster has no spring unit.

Another electromagnetic camshaft adjuster is described in EP 2 252 774 B1, which is also placed on the front side of a camshaft of an internal combustion engine and effects an axial movement of the camshaft adjuster as a response to an energisation of the stationary coil unit and by the movement effected thereby of the armature unit or of the associated armature plunger. The yoke unit there is supported in a manner so as to be rotational relative to the coil unit. By contrast, the armature unit with the armature plunger is mounted to be stationary in the rotational yoke and core unit. In this way, the overall armature unit together with the surrounding yoke unit can rotate together with the camshaft.

Finally, also EP 1 421 591 B1 describes an electromagnetic camshaft adjuster. Here, a permanent magnet disc is also provided between two pole discs, which in turn is fixedly connected to the armature unit or the armature plunger. The permanent magnet unit ensures in the resting position, which means when the coil is not energised, that the armature unit is held on the pole core. It is not until the coil is energised with a current that a magnetic field that acts against the field of the permanent magnet discs and the armature unit is repulsed by a spring force supported by the pole core. To this end, a coil spring is provided, the spring force of which is dimensioned to be smaller than the holding force of the permanent magnet disc in the non-energised condition of the coil unit. As soon as the spring force of the coil spring is stronger than an attraction or holding force of the permanent magnet disc, an energisation of the coil with current can be removed and the assembly is held in the extended condition of the armature plunger, without a current having to be supplied to the coil.

SUMMARY

The present disclosure provides a further electromagnetic camshaft adjuster that is simple to manufacture and still allows very fast switching times, in particular switching times of less than three milliseconds.

The present application provides an electromagnetic camshaft adjuster having the features and structures disclosed herein.

It is here advantageous for the electromagnetic camshaft adjuster according to the present disclosure that the permanent magnet unit is mounted to be stationary between a housing cover and the pole core of the electromagnetic drive unit. In addition, the armature plunger is provided to be rotatable in an armature of the armature unit, and the spring unit is supported on a part of the armature unit that is preferably mounted in a rotationally fixed or a substantially rotationally fixed manner. The part of the armature unit may be the armature itself, in which the armature plunger is rotatably seated.

Such an electromagnetic camshaft adjuster is characterised by a very compact design and by very constant switching times, which may be below three milliseconds. What is of particular advantage here is the stationary mounting of the permanent magnet between the housing cover and the pole core. This simplifies the design of the electromagnetic camshaft adjuster because the permanent magnet can be installed without any bearing or guide bushings.

In the present disclosure, the armature unit is formed as a pot-shaped armature, the bottom of which is provided with an opening through which the armature plunger extends. The armature plunger is here preferably mounted so as to be rotational in the armature. Such a rotational mounting of the armature plunger in or on the armature has the advantage that the armature itself may be mounted so as to be merely axially displaceable, but rotationally fixed, in the electromagnetic camshaft adjuster.

According to the disclosure, the armature unit or the armature may here be guided in a guide bushing so as to be axially movable, but rotationally fixed. Such a rotational fixing may be achieved for example by providing the guide bushing on the side thereof that faces the armature unit and the armature unit on the side thereof that faces the guide bushing with a tongue-and-groove guide that extends along the central axis of the electromagnetic camshaft adjuster.

According to the disclosure, the armature plunger protrudes through the bottom of the pot-shaped armature and is encompassed and retained on the inside of the armature at the bottom by a retaining disc, preferably in such a way that the armature plunger can continue to rotate in the armature and in the opening of the retaining disc.

The spring unit provided according to the present disclosure for a force-related support of the movement of the armature unit in the direction of the camshaft is supported at one end thereof on a suitable surface within the camshaft adjuster, for example on the housing cover, and is supported on the armature unit at its opposite end that faces the camshaft. Preferably, the spring unit is here supported at one end on the bottom of the pot-shaped armature. The advantage of this is that the spring unit is supported on both of its ends on surfaces which rotate not at all or only very slightly during operation, so that no friction occurs on the support surfaces of the spring unit. For this reason, it is provided in a development of the present disclosure that the above-mentioned retaining disc has a smaller diameter than the spring unit that is preferably formed as a coil spring. As a result, the front end of the spring unit may be supported on the bottom of the armature of the armature unit.

BRIEF DESCRIPTION OF THE DRAWINGS

The electromagnetic camshaft adjuster according to the present application will be explained in more detail below in connection with figures by way of an embodiment example, wherein.

DETAILED DESCRIPTION

Figures 1, 2, 3:
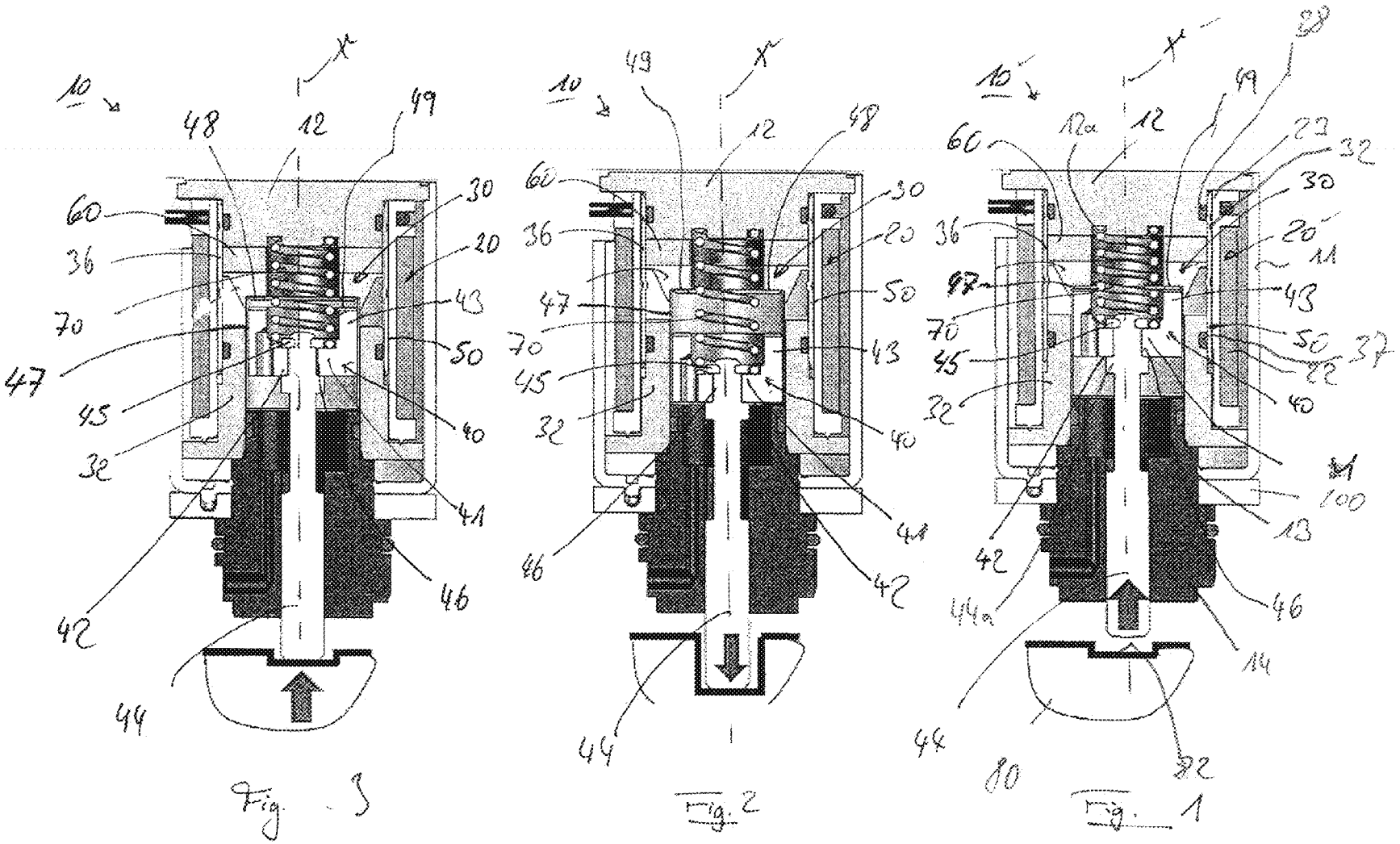
FIG. 1 shows a longitudinal section through an electromagnetic camshaft adjuster in the resting position with the coil not energised.
FIG. 2 shows the electromagnetic camshaft adjuster of FIG. 1 with an extended armature plunger.
FIG. 3 shows the electromagnetic camshaft adjuster of FIGS. 1 and 2 in the returning condition, in which the camshaft presses against the armature plunger.

In the figures following below, the same reference signs identify the same parts with the same meaning, unless otherwise specified.

FIG. 1 shows the electromagnetic camshaft adjuster in a resting condition, i.e. with the exciter coil 22 not excited. It is assumed here that the armature plunger 44 is initially in its top position. In this condition, a magnetic force flux is provided by the permanent magnet unit 60, which keeps the armature unit 40 attracted to the pole core 30. Also, a gap 49 is provided between the pole core 30 and the armature unit 60, where the gap 49 is formed to increase towards a central axis (X) of the electromagnetic camshaft adjuster. It is essential here that the spring unit 70, i.e. the provided coil spring in the embodiment example, has a spring force that is dimensioned to be lower than the retaining force of the permanent magnet unit 60 in the non-excited condition of the exciter coil 22.

The adapter element 14 extends through a flange 100. On this flange 100, the housing 11 of the electromagnetic camshaft adjuster 10 is seated.

On the inside of the electromagnetic camshaft adjuster 10, a pole core 30 is provided at a distance from the surface of the cover 12 that faces the inside of the electromagnetic camshaft adjuster 10. This pole core 30 is directed towards the camshaft 80 and is formed with a conically tapered circumferential surface for providing a control cone in a manner that is known per se. Between the pole core 30 and the cover 12, a permanent magnet unit 60 in the form of a permanent magnet disc is provided. The cover 12, the permanent magnet unit 60 and the pole core 30 are here stationary and are placed within the housing 11 preferably without a gap relative to each other.

As can be seen from FIG. 1, both the pole core 30 and the permanent magnet disc 60 are designed to be annular and have a central opening through which a spring unit 70, presently a coil spring, extends. The coil spring 70 is here oriented centrally to the central axis X and is supported at the end thereof that is shown at the top in FIG. 1 in an annular groove 12*a* of the cover 12. With its opposite end, the coil spring 70 is supported on the bottom 42 of a pot-shaped armature 41. From the bottom 42 of the armature 41, a peripheral wall 43 of the armature 41 extends upwards and encompasses the coil spring 70. The bottom 42 of the armature 41 has an opening 46, through which the upper end of an armature plunger 44 protrudes. This armature plunger 44 forms the above-mentioned actuator element for the camshaft 80. The armature plunger 44 is encompassed at the end thereof that protrudes through the bottom 42 of the armature 41 by a retaining disc 45 and is fixed thereby to the armature 41. This fixing is achieved by the retaining disc 45 as a result of the fact that it engages in a peripheral groove at the top end of the armature plunger 44 in a manner similar to a locking ring and interacts at the bottom end of the bottom 42 of the armature 41 with a flange 44*a* of the armature plunger 44 that protrudes in a circular manner.

The armature 41 with its bottom 42 and its wall 43 forms, together with the armature plunger 44, an armature unit 40. The entire armature unit 40, i.e. the armature 41 and the armature plunger 44, are axially movable in the axial direction of the central axis X. This means that during an axial movement of the armature 41, the armature plunger 44 that is axially fixed to the armature is moved at the same time. To this end, the armature 41 is seated in a guide bushing 47 that allows an axial movement of the armature 41. However, the armature 41, unlike the armature plunger 44, is mounted within this guide bushing 47 so that it cannot, or almost not, rotate. To this end, for example a suitable groove-and-tongue connection is provided. Thus, the guide bushing 47 may for example have a longitudinal groove that extends parallel along the central axis X, into which a protruding longitudinal web that also extends parallel along the central axis X engages on the circumferential wall 43 of the armature 41. For the purpose of enhancing clarity, such a tongue-and-groove connection between the armature 41 and the guide bushing 47 is not shown in FIG. 1. Although in another variant the armature 41 may in principle be provided to be rotatable in relation to the guide bushing 47, as a result of the spring force of the spring unit 70, the armature 41 is axially pretensioned in such a way that the latter can be rotated only against the spring force applied by the spring unit 70. In the case of a correspondingly large dimensioning of the spring force, the armature 41 is placed so as to be virtually rotationally fixed. Compared with this, however, the armature plunger 44 can be rotated with comparative ease within the armature 41. Consequently, this solution results in the fact that the armature plunger 44 will rotate during operation, but the armature 41 will not.

Thus, whilst the armature 41 is axially displaceable along the central axis X, but not rotatable, such a rotation of the armature plunger 44 is allowed and expressly provided for. To this end, the armature plunger 44 is placed in the opening 46 in the bottom 42 of the armature 41 so as to be rotatable. Such a rotatable placement of the armature plunger 44 may be achieved for example as a result of the fact that a certain play is provided between the opening 46 of the armature 41 and the armature plunger 44 on the one hand and in between the distance of the retaining disc 45 and the flange 44*a*.

For the sake of completeness it is to be noted in connection with the representation of FIG. 1 that a flange-shaped yoke part 32 is provided which is placed so as to be stationary within the housing 11 of the electromagnetic camshaft adjuster 10 and constitutes the magnetic counterpiece to the pole core 30. The pole core 30 and the yoke part 32 are preferably fixed to a further sleeve 36, for example by welding. In addition, both the cover 12 and the yoke part 32 are sealed relative to the sleeve 36 by sealing rings 37, 38.

An electromagnetic camshaft adjuster 10 as shown in FIG. 1 operates as follows. Reference is in this respect also made to the representations in FIGS. 2 and 3, which show the electromagnetic camshaft adjuster 10 in each case in different operating conditions which will be explained below. However, the known reference numerals are the same.

FIG. 1 shows the electromagnetic camshaft adjuster in a resting condition, i.e. with the exciter coil 22 not excited. It is assumed here that the armature plunger 44 is initially in its top position. In this condition, a magnetic force flux is provided by the permanent magnet unit 60, which keeps the armature unit 40 attracted to the pole core 30. It is essential here that the spring unit 70, i.e. the provided coil spring in the embodiment example, has a spring force that is dimensioned to be lower than the retaining force of the permanent magnet unit 60 in the non-excited condition of the exciter coil 22.

If in the next step current flows through the exciter coil 22 so that the force effected thereby counteracts the force of the permanent magnet unit 60, the force of the permanent magnet unit 60 is minimised or cancelled out, so that the spring force of the spring unit 70 is sufficient to force the armature 41 on the armature plunger 44 away. In the case of a corresponding excitation of the exciter coil 22, this can be carried out so quickly that a forcing away of the armature plunger 44 can be achieved within less than 3 ms, in order to engage in the camshaft groove 82 of the camshaft 80 and to adjust the latter correspondingly. In the maximum extended position of the armature plunger 44 as shown in FIG. 2, the force of permanent magnet unit 60 is then no longer sufficient to return the plunger 41.

Such a return will not be possible until the camshaft groove 82 of the camshaft 80 forces the armature plunger 44 back, as shown in FIG. 3. As soon as the armature 41 is close enough to the pole core 30, the force flux via the permanent magnet 60 becomes so great that the armature is pulled back further into its resting position, until the latter has again reached its resting position according to FIG. 1.

LIST OF REFERENCE NUMERALS

10 Electromagnetic camshaft adjuster
11 Housing
12 Cover
12*a* Groove
13 Opening
14 Adapter element
20 Stationary coil unit
22 Input coil
23 Coil carrier body
30 Pole core
32 Yoke part
36 Sleeve
37 Sealing ring
38 Sealing ring
40 Armature unit
41 Armature
42 Bottom
43 Wall
44 Armature plunger
44*a* Flange
45 Retaining disc
46 Opening
47 Guide bushing
48 Annular flange
49 Gap
50 Guide bushing
52 Flange
60 Permanent magnet unit
70 Spring unit
80 Camshaft
82 Camshaft groove
100 Flange
X Central axis

The invention claimed is:

1. An electromagnetic camshaft adjuster, comprising:
a movable armature unit movable relative to a pole core by exciting a stationary coil unit with a current;
an armature plunger;
a permanent magnet unit, through which the armature unit is held in a resting position in a non-excited condition of the coil unit;
a spring unit between the pole core and the armature unit, the spring unit providing a spring force to force the armature unit axially away from the pole core, wherein the spring force of the spring unit is dimensioned so as to be smaller than a holding force of the permanent magnet unit in the non-excited condition of the coil unit;
wherein the permanent magnet unit is provided to be stationary between a housing cover and the pole core,
wherein the armature plunger is provided in an armature so as to be rotatable,
wherein the spring unit is supported on the armature, and
wherein the armature unit is axially movable in a guide bushing, and the armature unit is guided in the guide bushing in a rotationally fixed manner.

2. The electromagnetic camshaft adjuster according to claim 1, wherein the armature unit has a pot-shaped armature with a bottom in which an opening is provided, and wherein the armature plunger extends through the opening.

3. The electromagnetic camshaft adjuster according to claim 2,
wherein the spring unit is a compression spring that is supported in the bottom of the armature.

4. The electromagnetic camshaft adjuster according to claim 1,
wherein a gap is provided between the pole core and the armature unit, wherein the gap is formed to increase towards a central axis (X) of the electromagnetic camshaft adjuster.

5. The electromagnetic camshaft adjuster according to claim 1,
wherein the pole core and a yoke unit are connected to each other in a stationary manner via a sleeve.

6. The electromagnetic camshaft adjuster according to claim 5,
wherein the pole core and the yoke unit are welded together with the sleeve.

7. The electromagnetic camshaft adjuster according to claim 2,
wherein the armature plunger is encompassed and fixed in the bottom of the pot-shaped armature by a retaining disc.

8. A camshaft adjuster, comprising:
a movable armature unit comprising:
a pot-shaped armature having a bottom with an opening; and
a rotatable armature plunger that extends through the opening,
wherein the movable armature unit is movable relative to a pole core by exciting a stationary coil unit with a current and wherein, in a non-excited condition of the stationary coil unit, the movable armature unit is held in a resting position by a magnet unit between a housing cover and the pole core;
a spring unit located between the pole core and the movable armature unit and supported on the armature, the spring unit biased with a spring force to force the movable armature unit axially away from the pole core, wherein the spring force is less than a holding force of the magnet unit in the non-excited condition of the stationary coil unit;

a guide bushing; and wherein the movable armature unit is axially movable in the guide bushing while being rotationally fixed with respect to the guide bushing.

9. The camshaft adjuster according to claim 8, wherein the rotatable armature plunger is encompassed and fixed in the bottom of the pot-shaped armature by a retaining disc.

10. The camshaft adjuster according to claim 8, further comprising:

a yoke unit; and a sleeve;

wherein the yoke unit and the pole core are connected to each other in a stationary manner via the sleeve.

11. The camshaft adjuster according to claim 10, wherein the pole core and the yoke unit are welded together with the sleeve.

12. An electromagnetic camshaft adjuster, comprising:

a movable armature unit movable relative to a pole core by exciting a stationary coil unit with a current;

an armature plunger;

a permanent magnet unit, through which the armature unit is held in a resting position in a non-excited condition of the coil unit;

a spring unit between the pole core and the armature unit, the spring unit providing a spring force to force the armature unit axially away from the pole core, wherein the spring force of the spring unit is dimensioned so as to be smaller than a holding force of the permanent magnet unit in the non-excited condition of the coil unit;

wherein the permanent magnet unit is provided to be stationary between a housing cover and the pole core, wherein the armature plunger is provided in an armature so as to be rotatable, wherein the spring unit is supported on the armature, wherein a gap is provided between the pole core and the armature unit, wherein the gap is formed to increase towards a central axis (X) of the electromagnetic camshaft adjuster, and wherein the armature unit is axially movable in a guide bushing, and the armature unit is guided in the guide bushing in a rotationally fixed manner.

13. The electromagnetic camshaft adjuster according to claim 12, wherein the pole core and a yoke unit are connected to each other in a stationary manner via a sleeve.

14. The electromagnetic camshaft adjuster according to claim 13, wherein the pole core and the yoke unit are welded together with the sleeve.

15. An electromagnetic camshaft adjuster, comprising:

a movable armature unit movable relative to a pole core by exciting a stationary coil unit with a current;

an armature plunger;

a permanent magnet unit, through which the armature unit is held in a resting position in a non-excited condition of the coil unit;

a spring unit between the pole core and the armature unit, the spring unit providing a spring force to force the armature unit axially away from the pole core, wherein the spring force of the spring unit is dimensioned so as to be smaller than a holding force of the permanent magnet unit in the non-excited condition of the coil unit;

wherein the permanent magnet unit is provided to be stationary between a housing cover and the pole core, wherein the armature plunger is provided in an armature so as to be rotatable, wherein the spring unit is supported on the armature, wherein the pole core and a yoke unit are connected to each other in a stationary manner via a sleeve, wherein the pole core and the yoke unit are welded together with the sleeve.

16. A camshaft adjuster, comprising:

a movable armature unit comprising:

a pot-shaped armature having a bottom with an opening; and a rotatable armature plunger that extends through the opening, wherein the movable armature unit is movable relative to a pole core by exciting a stationary coil unit with a current and wherein, in a non-excited condition of the stationary coil unit, the movable armature unit is held in a resting position by a magnet unit between a housing cover and the pole core;

a spring unit located between the pole core and the movable armature unit and supported on the armature, the spring unit biased with a spring force to force the movable armature unit axially away from the pole core, wherein the spring force is less than a holding force of the magnet unit in the non-excited condition of the stationary coil unit;

a yoke unit;

a sleeve;

wherein the yoke unit and the pole core are connected to each other in a stationary manner via the sleeve, and wherein the pole core and the yoke unit are welded together with the sleeve.

17. The camshaft adjuster according to claim 16, further comprising:

a guide bushing; and wherein the movable armature unit is axially movable in the guide bushing while being rotationally fixed with respect to the guide bushing.

* * * * *